US008009703B2

(12) United States Patent
Lauterbach et al.

(10) Patent No.: US 8,009,703 B2
(45) Date of Patent: Aug. 30, 2011

(54) METHOD AND DEVICE FOR TRANSMITTING COMPLEMENTARY DATA IN AN ANALOG RADIO TRANSMISSION SYSTEM

(75) Inventors: Thomas Lauterbach, Nuremberg (DE); Frank Hofmann, Hildesheim (DE)

(73) Assignee: Robert Bosch GmbH, Stuttgart (DE)

( * ) Notice: Subject to any disclaimer, the term of this patent is extended or adjusted under 35 U.S.C. 154(b) by 514 days.

(21) Appl. No.: 11/631,198

(22) PCT Filed: May 31, 2005

(86) PCT No.: PCT/EP2005/052478
§ 371 (c)(1),
(2), (4) Date: May 12, 2009

(87) PCT Pub. No.: WO2006/003063
PCT Pub. Date: Jan. 12, 2006

(65) Prior Publication Data

US 2010/0002609 A1 Jan. 7, 2010

(30) Foreign Application Priority Data

Jul. 2, 2004 (DE) ..... 10 2004 032 286

(51) Int. Cl.
*H04H 20/22* (2008.01)

(52) U.S. Cl. ..... 370/522; 455/179.1

(58) Field of Classification Search ..... 370/522; 455/179.1
See application file for complete search history.

(56) References Cited

U.S. PATENT DOCUMENTS

| | | | |
|---|---|---|---|
| 4,540,849 | A | 9/1985 | Oliver |
| 6,201,798 | B1 | 3/2001 | Campanella et al. |

FOREIGN PATENT DOCUMENTS

| | | |
|---|---|---|
| CA | 2 098 384 | 2/2000 |
| EP | 0 2220744 | 5/1987 |
| KR | 2003-0038449 | 5/2003 |
| WO | 92 10888 | 6/1992 |

OTHER PUBLICATIONS

ETSI EN 301 700 V1.1.1 (Mar. 2000), Digital Audio Broadcasting (DAB); VHF/FM Broadcasting: cross-referencing to simulcast DAB services by RDS-ODA 147, pp. 1-14.*

*Digital Audio Broadcasting (DAB), VHF/FM Broadcasting: Cross-Referencing to Simulcast DAB Services by RDS-ODA 147, ETSI EN 301 700*, European Telecommunications Standards Institute, Sophia-Antipo, France, Mar. 2000, vol. BC, No. VIII, p. 5, In. 1; p. 7, In. 13, and p. 11, paragraph 6.

F. Kozamernik, *Digital Audio Braodcasting*, EBU Review—Technical European Broadcasting Union, Brussels, Belgium, Mar. 21, 1999, pp. 13-27.

M. Ohsmann, *Digital Additional Information in the AM Broadcasting*, Radio Television Electronics, Verlag Technik (Publisher), Berlin, Germany, vol. 45, No. 3, Mar. 3, 1996, pp. 38-40.

*Digital Radio Mondiale (DRM); System Specification*, European Telecommunication Standards Institute in Sep. 2001, service description channel (SDC), chapter 6.4, pp. 63-78.

*Data System in Monophonic AM Sound Broadcasting (AMDS)*, ITU Recommendation BS. 706-2,, Feb. 1998.

* cited by examiner

*Primary Examiner* — Melvin Marcelo
(74) *Attorney, Agent, or Firm* — Kenyon & Kenyon LLP

(57) ABSTRACT

Method and device for transmitting complementary data in an analog radio transmission system, the complementary data including information with respect to alternative transmitting frequencies of the respective program, and the alternative transmitting frequencies relating to digital radio transmission systems. The alternative transmitting frequencies for digital radio transmission systems are transmitted in the AMDS (amplitude modulation data system) format, in that these SCD (service description channel) data are copied into the AMDS format, using mapping.

27 Claims, 4 Drawing Sheets

METHOD AND DEVICE FOR TRANSMITTING COMPLEMENTARY DATA IN AN ANALOG RADIO TRANSMISSION SYSTEM

FIELD OF THE INVENTION

The present invention relates to a method and a device for transmitting complementary data in an analog radio transmission system, the complementary data including information with respect to alternative transmission frequencies of the respective program, and the alternative transmission frequencies relate to digital radio transmission systems. The alternative transmission frequencies for digital radio transmission systems are transmitted in the AMDS (amplitude modulation data system) format, in that these SCD (service description channel) data are copied into the AMDS format, using mapping.

BACKGROUND INFORMATION

A digital radio transmission system is known from technical specification (ETSI TS 101 980), having the title "digital radio mondiale (DRM); System Specification", and published by the European Telecommunication Standards Institute in September, 2001, which, for instance, is transmitted on the usual AM frequencies, and, among other things, has a Service Description Channel (SDC) which is described on pages 63 to 78, as chapter 6.4. In the DRM system, the data are subdivided into SDC blocks and transmitted. Each block includes an indicator, called AFS index, and a data field by which useful data are transmittable, and a check word that is used for error detection and error correction. In this instance, the AFS index is a signless binary number between 0 and 15, which gives the number of the transmission of so-called super frames, which separate this SDC block from the next one having identical content, provided the 0 symbol is set in the identification field of the fast access channel. In this connection, the AFS index is supposed to be identical for all SDC blocks, and may be changed, for example, in response to a reconfiguration. The data field is subdivided into a variable number of data blocks (data entities). It may include an end marking in this case, as well as padding bits which fill up free fields. The length of this data field, in this instance, depends on the transmission mode selected, which determines the robustness of the transmission system. The check field, also called cyclic redundancy check (CRC), includes a 16-bit CRC data word which is calculated via the AFS index and the data field.

A protocol for analog radio transmission is known from ITU Recommendation BS. 706-2, having the title, "Data System in Monophonic AM Sound Broadcasting (AMDS)", of February 1998, with which complementary data with respect to alternative frequencies are able to be transmitted, so that, in response to a serious deterioration in the quality of reception, switching is able to take place automatically to another reception frequency by the receiver.

In spite of the imminent introduction of DRM for digital radio transmission on long wave, middle wave and short wave, for a time, the same programs will be broadcast both in analog technology (AM) and in digital technology (DRM). Because of the limited number of channels, it may frequently be the case that an analog and a digital signal cannot both be transmitted in each frequency range. Especially on short wave, the various frequency ranges have different propagation ratios. Therefore, it may be necessary that a receiver that is first set to a DRM program and loses the signal there, has to change to another band in which, however, the program is only being transmitted in analog fashion. In order that it be able to refer additional possible alternative frequencies there, especially those on which digital transmission is being made, AMDS is used for the analog transmission.

SUMMARY OF THE INVENTION

It is the crux of the present invention to state a method and a device using which, in an analog radio transmission system, alternative frequencies of the transmitter, that has just been tuned in, are transmittable, these alternative transmitting frequencies being able to relate to the same frequency band, but referring to a digital radio transmission system, especially digital radio mondiale (DRM). This object is attained, according to the present invention.

The alternative transmitting frequencies for digital radio broadcasting systems are advantageously transmitted in amplitude modulation data system (AMDS) format.

It is also advantageous that the digital radio transmission system is broadcast in DAB (digital audio broadcast) format or in DRM (digital radio mondiale) format or in DVB-T (digital video broadcast-terrestrial) format or in iBiquity format or in IBOC (in band on channel) format or in AM/FM format or in UMTS (universal mobile telecommunications system) format. In particular, the use of DRM systems is advantageous, since DRM programs are transmitted in the AM band, on which analog sound broadcast programs are also broadcast, which use the AMDS protocol.

Furthermore, it is advantageous that the data transmitted in the AMDS format are SDC data, which are copied into the AMDS format, using mapping. Within the DRM system, the so-called service description channel is provided, using which the complementary data are able to be transmitted. These SDC data, which are received by a combination receiver, that is, by a receiver which is able to receive both analog AM signals and digital DRM signals, are able to be handled by this without additional expenditure. Therefore, it is provided, using the SDC format, to transmit data which, however, for broadcasting in analog radio transmission systems have to be copied into the so-called AMDS format with the aid of mapping.

It is also advantageous that the data blocks of the SDC information are entered into the data fields of the AMDS blocks.

Again, it is advantageous that, in addition, the AFS index of the SDC blocks are entered into the data fields of the AMDS blocks. Furthermore, it is advantageous that the bits of the check field of each AMDS group are generated from the data fields of the SDC data blocks entered into file.

Then, again, it is advantageous that a data bit of each AMDS group indicates whether a first or a subsequent AMDS group is involved, of a plurality of AMDS groups that are transmitted one after the other, which together include the information of an SDC block. In particular, it is of advantage that the first data bit of the first block of an AMDS group, that is, the m35 bit of the first AMDS block has a 1, that, in this instance, the first AMDS group of a plurality of AMDS groups is involved which are transmitted one after the other, and these first data bits of the first blocks of the following AMDS group, that is, the m35 bits of the first AMDS blocks, each have a 0.

Then, too, it is advantageous that the AMDS blocks are continuously numbered consecutively. It is particularly advantageous that the continuous numbering of each AMDS group is included in one or more AMDS data bits reserved for this.

It is of advantage that the one or more reserved AMDS data bits, which include the continuous numbering of each AMDS group, are the data bits following the first data bit m35 of the first AMDS block of an AMDS group, that is, data bits m34, m33, m32, . . . , depending on how many bits are required for the counter.

Moreover, it is of advantage that the same AMDS groups are transmitted in a multiple manner.

It is particularly advantageous that the continuous numbering of each AMDS group is included in an AMDS data field which is composed of several reserved AMDS data bits. Furthermore, it is of advantage that the continuous consecutive numbering of the AMDS groups takes place using synchronization, in that the content of the check field is calculated from the content of the data fields, using cyclical block codes, that offset value pairs are added to the check fields, that syndromes are calculated pair-wise from the offset values, and that, with the aid of the pair-wise syndromes obtained, the respective content of the AMDS groups is able to be determined.

It is also advantageous that the device includes a computation unit which ascertains check words, as a function of the information included in the AMDS data fields, for detecting errors and for correcting errors, and inserts them into the check fields of the AMDS check fields.

Moreover, it is advantageous that the apparatus has a counting device which continuously numbers consecutively the AMDS blocks, and that the numbering is inserted into an AMDS data field reserved for this.

Advantageously, a receiver is provided for the reception and reproduction of analog and digitally transmitted radio broadcast signals, during reproduction of an analog transmitted radio broadcast signal, the receiver receiving the complementary data, transmitted in AMDS format, with respect to alternative transmission frequencies on which the same program is transmitted digitally, evaluating it, and if alternative transmission frequencies, on which the same program is being transmitted digitally, are present, automatically switching over to the digitally transmitted alternative frequency.

Advantageously, the receiver stores all received complementary data, with respect to alternative transmission frequencies, in a databank, and selects from this databank the alternative frequency on which the tuned-in radio broadcast program is best received.

Advantageously, for the selection of an alternative frequency from the databank, the alternative frequencies are hunted in a predetermined sequence according to their type of transmission, especially in the sequence DAB, DRM, FM, AM.

DETAILED DESCRIPTION

Figure 1:
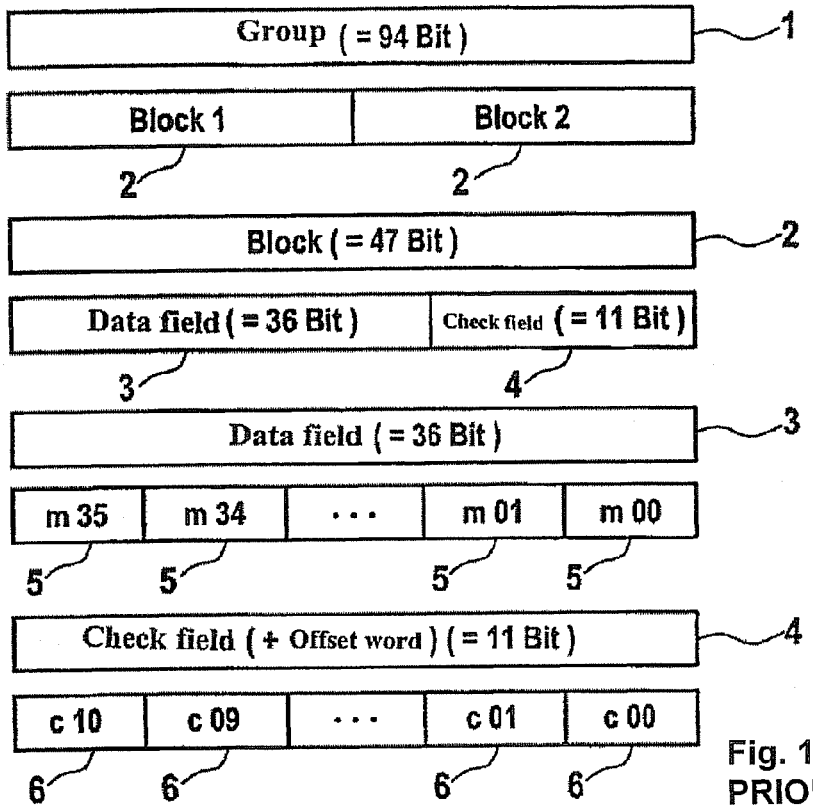
Fig. 1 PRIOR ART
FIG. 1 shows the construction of the AMDS (amplitude modulation data system) format.

The construction of the amplitude modulation data system is shown schematically in FIG. 1. An AMDS group 1 is made up of 94 bits, this AMDS group being subdivided in equal parts into an AMDS block1 2 as well as an AMDS block2 2, each at 47 bits. Such an AMDS block 2 having 47 bits is further subdivided into a data field 3 having 36 bits and a check field 4 having 11 bits, the data field transmitting the useful information, and check field 4 including a check word which is calculated from data field 3, using a cyclical code, and is used for error detection and error correction. Data field 3 that is 36 bits long is further subdivided into AMDS data bits 5 which begin beginning with the designation m35 and are named up to m00, the last AMDS data bit of the useful data. After that there is check field 4, which is made up of 11 AMDS check bits 6 which, beginning with c10, are consecutively numbered to c00. This check field 4 includes information that was calculated from data field 3 using a cyclical block code.

Figure 2:
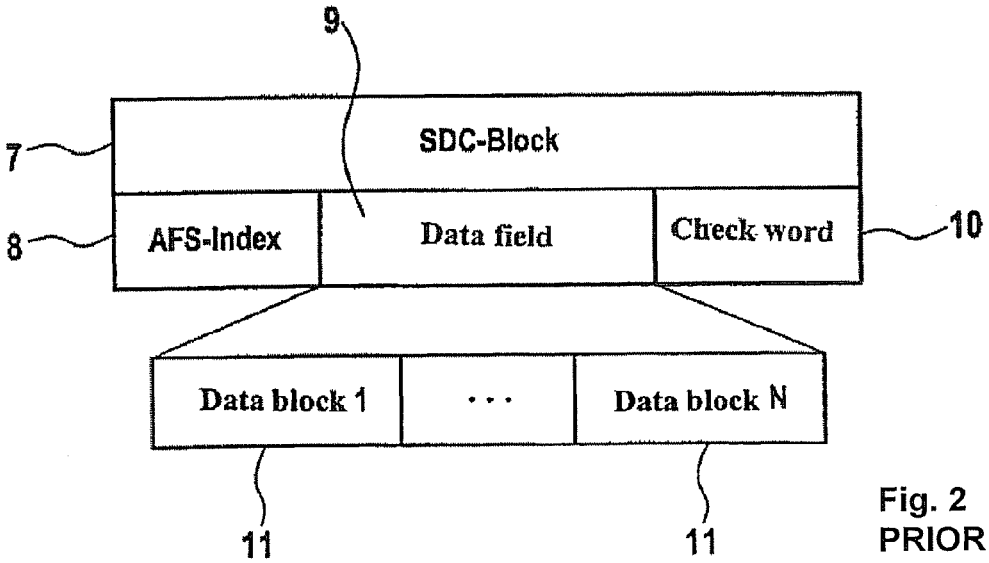
Fig. 2 PRIOR ART
FIG. 2 shows the construction of the SDC (service description channel) format, as it is used in DRM (digital radio mondiale).

In FIG. 2, the construction of a short description channel (SDC) block is shown, as is used in a digital radio broadcast system DRM (digital radio mondiale). Using the short description channel, information is transmitted which, for instance, refers to alternative frequencies of the same program, so that when there is an impairment in the quality of reception of the sound broadcast program currently tuned in, another frequency in the same frequency band or a different frequency band can be given, that is currently transmitting the same program. The digital sound broadcast program, in this case, is also in a position to refer either to alternative digital frequencies or to frequencies at which the same program is being transmitted using analog radio broadcasting methods such as FM or AM. Particularly in the transition phase, after the introduction of digital radio programs, the same radio broadcast programs will have to be broadcast both in analog and in digital form, since not every listener has a digital receiver available as yet. Especially in this transition phase it will not be possible to transmit complementary data, using programs, transmitted in an analog manner, that refer to alternative frequencies on which the same program is being transmitted in a digital transmission manner. SCD block 7 is made up of an AFS index 8, which is made up of 4 bits. According to this AFS index, a data field 9 is transmitted which may be variable in length and which transmits the useful data. In this instance, data field 9 may be made up of a different number of data blocks 11, which are consecutively numbered from 1 through N, depending on in which transmission mode and in which SDC mode transmission is instantaneously taking place. After data field 9 there follows a check word 10 within SDC block 7, which is made up of 16 bits and which is also designated as CRC (cyclic redundance check). This check word 10 is calculated from the bits of the AFS index and the data field, and is used for error detection and error correction of the transmitted data.

Figure 3:
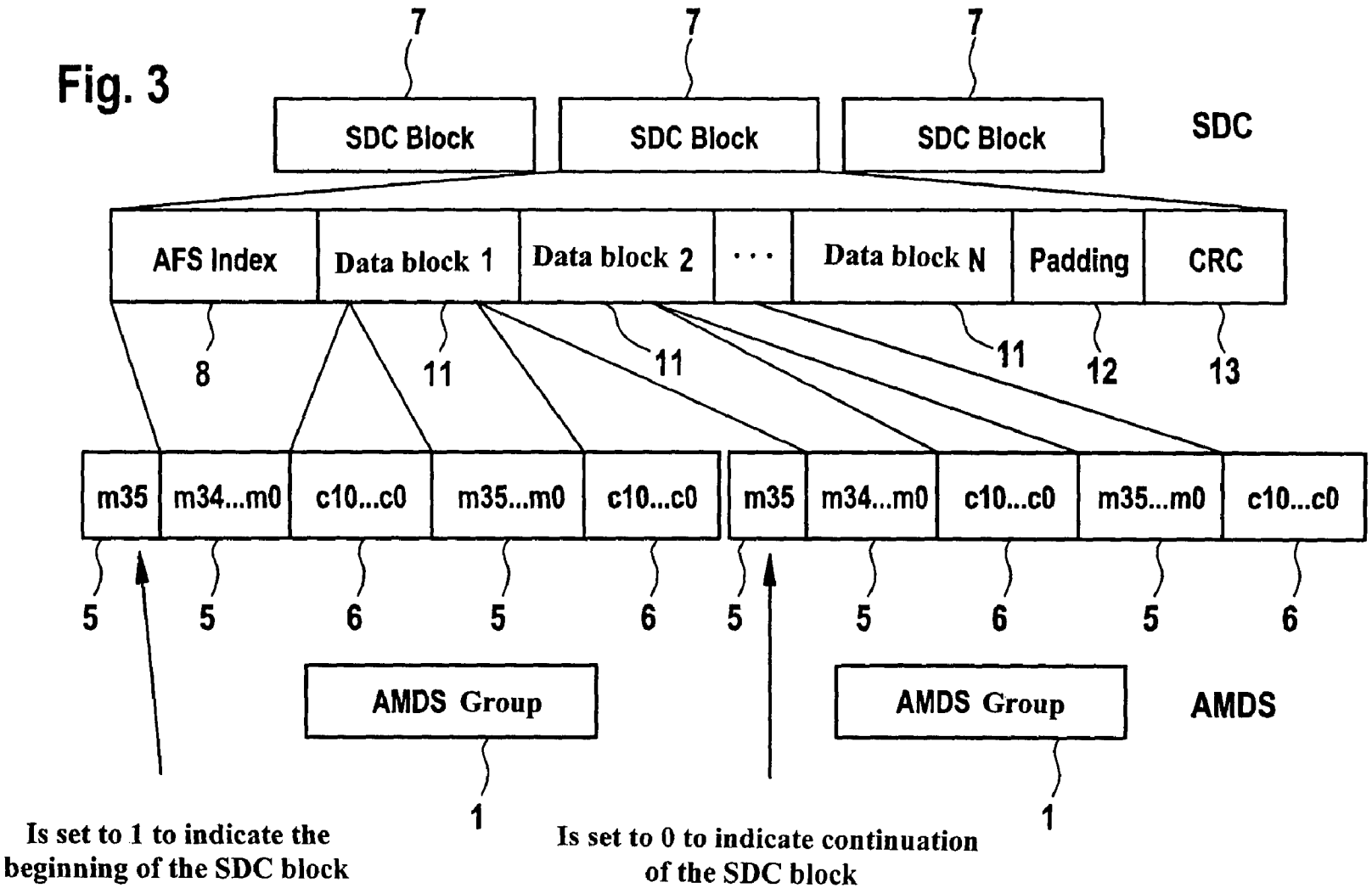
FIG. 3 shows the mapping of the SDC information on AMDS groups.

In FIG. 3, the SDC blocks, as they are transmitted, for instance, in the DRM system and the AMDS data structure are contrasted, in order to show the mapping for the transmission of the SDC data in AMDS format. For this, SDC blocks 7 are transmitted one after the other. Each SDC block 7 is made up, in this instance, of an AFS index 8, which is followed by 1 to N data blocks 11, which include the useful information. Subsequently, SDC block 7 includes padding bits 12 and a 16 bit cyclic redundancy check word 13. For the transmission of the SDC date, for this purpose, the AFS index information in block 8 and the information of data blocks 1 to N 11 are imported into the AMDS data structure, padding bits 12 as well as CRC bits 13 remaining unconsidered. Since an AMDS group 1 includes in each case two AMDS blocks each having 47 bits, each AMDS group has useful bits m35 to m00, and following this 11 AMDS check bits c10 to c00, as well as, once more, for AMDS block2 36 useful bits m35 to m00 as well as 11 check bits of AMDS block 2 c10 to c00. Since first useful bit m35 of the first block of the AMDS group 1 is reserved in order to indicate the beginning of an SDC block, or in order to indicate a continuation of an SDC block, the first AMDS useful bit m35 of block 1 of an SMDS group 1 is not described using SDC data. Therefore, the information of AFS index 8 is written into AMDS data bits m34 and the following ones of the first AMDS block of AMDS group 1. Data blocks 1 to N 11, that follow AFS index 8, are continuously written into AMDS data bits 5, AMDS data bits m34 to m00 of AMDS block1 as well as AMDS data bits m35 to m00 of AMDS block2 being available for this. These AMDS data bits are interrupted by AMDS check bits c10 to c00, which in each case are calculated as a function of the preceding AMDS data bits and written in. Since, based on the data volume of an SDC block, it is not possible to import the useful data of an SDC block completely into a AMDS group, several AMDS groups 1 are hanged one behind the other until the complete useful information of an SDC block is accommodated in AMDS groups 1. Therefore, for transmitting the information of one SDC block 7, it is necessary to transmit several consecutive AMDS groups 1, which is why it is furthermore meaningful, using first AMDS useful bits m35 of the first AMDS block to indicate whether the present AMDS group 1 includes the beginning of an SDC block, or whether a subsequent AMDS group 1 is involved, which was preceded by an AMDS group 1 that began with an SDC block. First AMDS data bit m35 of the first AMDS block is able to be used for this, in that the m35 bit of this first AMDS block of an AMDS group is set to 1 when the first AMDS group is involved, which includes the beginning of the useful data of an SDC block, or in that the m35 bit of the first AMDS block of an AMDS group is set to 0, to indicate that this AMDS group is a continuation of a preceding AMDS group, which relates to the same SDC block. Check bits c10 to c00 6 of AMDS groups 1 are calculated as a function of preceding useful bits m35 to m00 and transmitted. Furthermore, it is meaningful to continuously number the AMDS groups, since transmission in the AM band is frequently interfered with, and therefore a multiple transmission of the AMDS groups one after another is advantageous. By the sequential numbering of the AMDS groups it may be determined which AMDS groups, that were transmitted one after another having the same content, belong together and beginning at which AMDS group new information is being transmitted. So that the receiver is able to recognize the repetitions, or rather that the receiver is able to recognize when a new AMDS group is being transmitted, it is further advantageous that a continuous counter is provided. In this case, the AMDS groups, which contain the same information, may also be transmitted in a multiple manner and optionally at spaced intervals, which advantageously requires a 3 or 4 bit counter.

Figure 4:
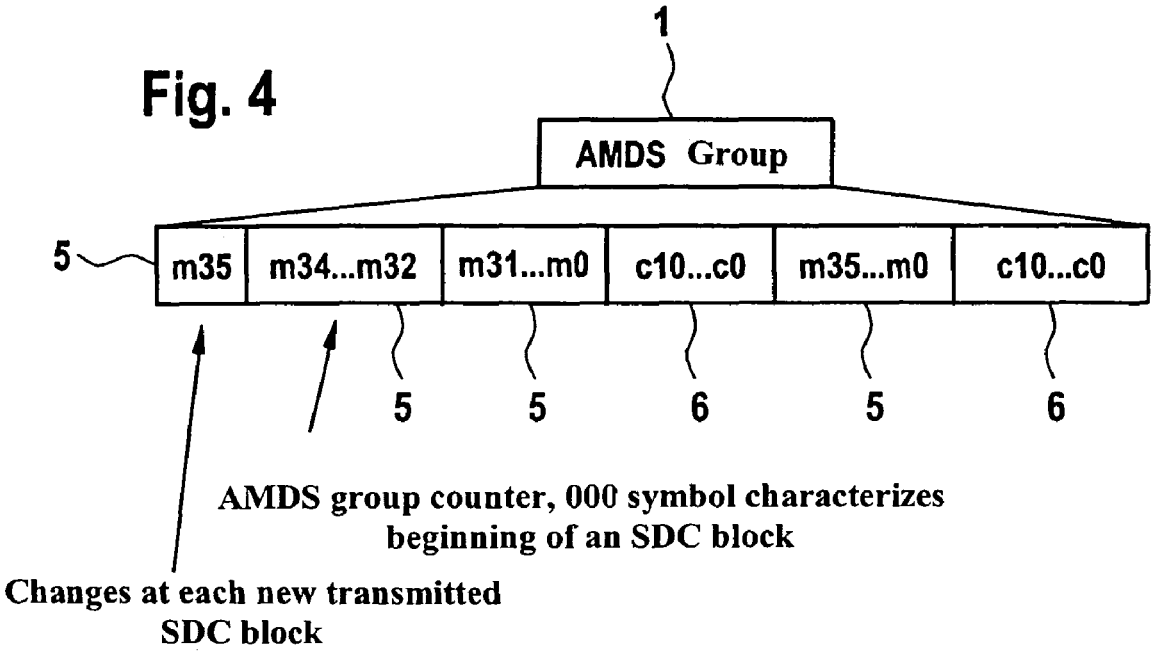
FIG. 4 shows the implementation of a counter.

FIG. 4 shows such a counter, in which an AMDS group 1 is shown, which is made up of two consecutive AMDS blocks, each AMDS block being made up of useful bits m35 to m00 and following that, of check bits c10 to c00. Since the first data bit of the first AMDS block of AMDS group 1 (m35) is reserved for indicating the beginning or the continuation of an SDC block, the subsequent 3 bits or 4 bits, namely bit m34 to m32 or m34 to m31 of the first AMDS block of the AMDS group are reserved for an AMDS group counter, so that for the actual information, AMDS useful bits m31 to m00 and m30 to m00 of the first AMDS block, as well as data bits m35 to m00 of the second AMDS block of the AMDS group are available. The AMDS group counter which, for example, is able to be implemented using useful bits m34 to m32 of the first AMDS block, begins advantageously with a 0 symbol, in order to indicate the beginning of an SCD block. By contrast, the following AMDS groups include incremented counter symbols in order to be able to detect beginning at what point a new SDC block is being transmitted.

Alternatively to this, it is also possible to implement the counter implicitly using the synchronization mechanism in that, additionally, pairs of offset words are specified, the number of offset word pairs corresponding to the number of groups that the counter is supposed to distinguish. In the receiver, the offset word pairs are added in a binary manner to the check words of the two blocks of which the AMDS group is made up. Groups having the same content use the same offset word pairs, in this connection. For the synchronization of the receiver, the bit stream received is supplied to the decoder in blocks of 47 bits, and a syndrome is calculated. Then the block subdivision is shifted by one bit and the syndrome of the code word thus created is calculated again. When the first syndrome of a syndrome pair is created, the next 47 bit block is supplied to the decoder. When the second syndrome of the syndrome pair is then created, the synchronization has been achieved. In the following blocks the corresponding offset words are then added, and the blocks are supplied to the decoder. If the syndrome 0 is created, the block is free from error and is able to be decoded. In this connection, it should be observed that, in consecutive blocks, in each case a pair of offset words belonging to each other is used. Once the synchronization has taken place, at the next block each of the first offset words of the offset pairs has to be added until decoding using syndrome 0 is possible. Then, the next following block is able to be decoded using the appertaining second offset word of the offset word pair.

Figure 5:
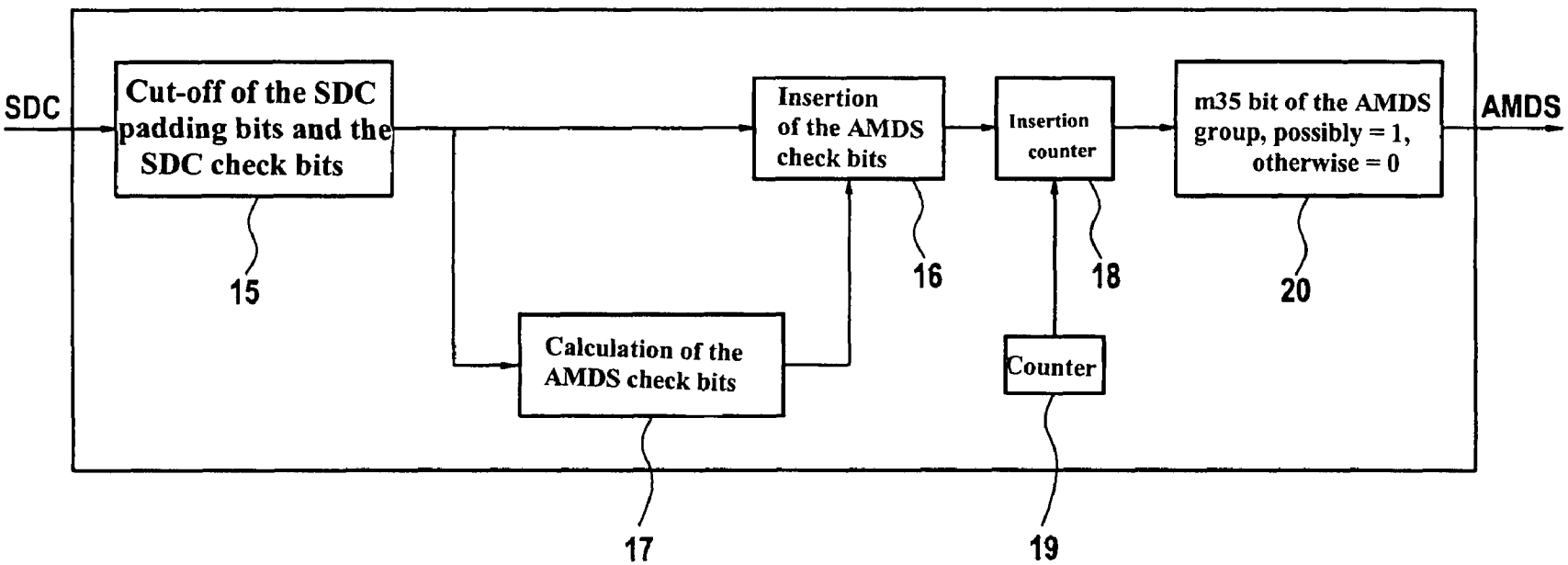
FIG. 5 shows a schematic representation of an exemplary embodiment of the device according to the present invention.

FIG. 5 shows a schematic block diagram of a device according to the present invention. For this, SDC blocks are supplied to mapping apparatus 14 which are output as AMDS groups after processing has taken place. The SDC blocks supplied to mapping apparatus 14 reach a cut-off device 15, in which padding bits 12 and check bits (CRC) 13 of the SDC blocks are removed. Thereafter, the output signal of cut-off device 15 is supplied to a check bit insertion device 16. At the same time, the output signal of cut-off device 15 is supplied to a check bit calculation device 17, in which, respectively, check bits c10 to c00 are calculated, from AMDS data fields m35 to m00, and these are supplied to check bit inserting device 16, by which calculated check bits c10 to c00 of check field 4 are inserted at the provided locations of the AMDS block. After the insertion of the AMDS check bits, the output signal of check bit inserting device 16 is passed on to counter inserting device 18. To counter inserting device 18, signals of a counter device 19 are supplied, which consecutively numbers the individual AMDS blocks and supplies this numbering to counter inserting device 18, which inserts these into the useful bits first useful bits of the first block of an AMDS group, that is, in the case of a 3 bit counter at locations m34 to m32 of the first block. If a 4 bit counter is used, bits m34 to m31 of the first block of an AMDS group are used. Subsequently, in beginning marking device 20, first useful bit m35 of block 1 of an AMDS group is set to 0 when this AMDS group includes the beginning of a new SDC block, or the m35 bit of the first block of the AMDS group is set to 0, when this AMDS group is a continuation of the information of an SDC block of a preceding AMDS group.

What is claimed is:

1. A method of an analog radio transmission system, comprising:

transmitting complementary data in AMDS (amplitude modulation data system) groups, the complementary data including information with respect to alternative transmitting frequencies of a respective program, wherein the AMDS groups are continuously consecutively numbered using a counter.

2. The method as recited in claim 1, wherein the alternative transmitting frequencies are transmitted for digital radio transmission systems in AMDS (amplitude modulation data system) format.

3. The method as recited in claim 1, wherein:

the alternative transmitting frequencies are transmitted for a digital radio transmission system, and the digital radio transmission system is broadcast in one of DAB (digital audio broadcast) format, in DRM (digital radio mondiale) format, in DVB-T (digital video broadcast-terrestrial) format, in iBiquity format, in IBOC (in band on channel) format, in AM/FM (amplitude modulation/frequency modulation) format, and in UMTS (universal mobile telecommunications system) format.

4. The method as recited in claim 1, wherein the data transmitted in AMDS (amplitude modulation data system) format are SDC (service description channel) data, which are copied into the AMDS format using mapping.

5. The method as recited in claim 4, wherein data blocks of the SDC information are imported into parts of the data fields of AMDS blocks.

6. The method as recited in claim 5, wherein in addition, an AFS index of the SDC blocks is imported into the data fields of the AMDS blocks, and bits of a check field of each AMDS group are generated from data fields of the imported SDC data blocks.

7. The method as recited in claim 1, wherein the continuous numbering of each AMDS group is included in one or more AMDS data bits that are reserved for this.

8. The method as recited in claim 7, wherein the one or the plurality of reserved AMDS data bits which include the continuous numbering of each AMDS group are the data bits following the first data bit of the first AMDS block of an AMDS group.

9. The method as recited in claim 6, wherein the same AMDS groups are transmitted multiple times.

10. The method as recited in claim 1, wherein the continuous consecutive numbering of the AMDS groups takes place using synchronization, in that:

the content of the check fields is calculated from the content of the data fields using cyclical block codes, offset value pairs are added to the check fields, syndromes are calculated pair-wise from the offset values, and the respective content of the AMDS groups is determinable with the aid of the pair-wise syndromes obtained.

11. A method of an analog radio transmission system, comprising:

transmitting complementary data in AMDS (amplitude modulation data system) groups, the complementary data including information with respect to alternative transmitting frequencies of a respective program;

wherein a data bit of each AMDS group indicates whether the respective AMDS group is a first or a subsequent AMDS group, of a plurality of AMDS groups that are transmitted one after the other, which together include information of an SDC (service description channel) block.

12. The method as recited in claim 11, wherein a first data bit of a first AMDS block of each AMDS group is used as the data bit for indicating whether the respective AMDS group is the first or subsequent AMDS group.

13. The method as recited in claim 11, wherein:

the data transmitted in AMDS groups are SDC data copied into the AMDS groups using a mapping;

data blocks of the SDC information are imported into parts of data fields of AMDS blocks of the AMDS groups; and an AFS index of the SDC blocks is imported into the data fields of the AMDS blocks, and bits of a check field of each AMDS group are generated from data fields of the imported SDC data blocks.

14. The method as recited in claim 11, wherein the alternative transmitting frequencies are transmitted for digital radio transmission systems in AMDS format.

15. The method as recited in claim 11, wherein:

wherein the alternative transmitting frequencies are transmitted for a digital radio transmission system, and the digital radio transmission system is broadcast in one of DAB (digital audio broadcast) format, DRM (digital radio mondiale) format, DVB-T (digital video broadcast-terrestrial) format, iBiquity format, IBOC (in band on channel) format, AM/FM (amplitude modulation/frequency modulation) format, and UMTS (universal mobile telecommunications system) format.

16. The method as recited in claim 11, wherein the data transmitted in AMDS (amplitude modulation data system) format are SDC data, which are copied into the AMDS format using mapping.

17. The method as recited in claim 16, wherein data blocks of the SDC information are imported into parts of the data fields of AMDS blocks.

18. The method as recited in claim 17, wherein in addition, an AFS index of the SDC blocks is imported into the data fields of the AMDS blocks, and bits of a check field of each AMDS group are generated from data fields of the imported SDC data blocks.

19. The method as recited in claim 18, wherein the same AMDS groups are transmitted multiple times.

20. A device for generating complementary data that are broadcast in an analog radio transmission system, the complementary data including information with respect to alternative transmitting frequencies of a respective program, comprising:

a processing circuit configured to:

convert SDC (service description channel) data into AMDS (amplitude modulation data system) data fields;

ascertain check words, as a function of information included in the AMDS data fields, for detecting and correcting errors; and insert the ascertained check words into AMDS check fields; and a counter device that continuously consecutively numbers the AMDS groups, wherein the numbers are inserted into at least one AMDS data field that is reserved therefor.

21. A receiver for receiving and for reproducing radio transmission signals transmitted in an analog and in a digital manner, comprising:

a processing circuit configured to:

during reproduction of a radio transmission signal, that is transmitted in an analog manner, evaluate received complementary data that is transmitted in AMDS groups, with respect to alternative transmitting frequencies on which the same program is being transmitted digitally; and automatically switch over to the digitally transmitted alternative frequency, if alternative transmission frequencies, on which the same program is being transmitted digitally, are present;

wherein the AMDS groups are continuously consecutively numbered using a counter.

22. The receiver as recited in claim 21, further comprising:

a databank for storing all the received complementary data, with respect to alternative transmission frequencies, wherein the processing circuit is configured to select from this databank the alternative frequency on which the tuned-in radio broadcast program is best received.

23. The receiver as recited in claim 22, wherein for the selection of an alternative frequency from the databank, the alternative frequencies are hunted in a predetermined sequence according to their type of transmission.

24. The receiver as recited in claim 23, wherein the predetermined sequence includes DAB, DRM, FM, AM.

25. A receiver for receiving and for reproducing radio transmission signals transmitted in an analog and in a digital manner, comprising:

a processing circuit configured to:

during reproduction of a radio transmission signal, that is transmitted in an analog manner, evaluate receiving complementary data that is transmitted in AMDS groups, with respect to alternative transmitting frequencies on which the same program is being transmitted digitally; and automatically switch over to the digitally transmitted alternative frequency, if alternative transmission frequencies, on which the same program is being transmitted digitally, are present;

wherein a data bit of each AMDS group indicates whether the respective AMDS group is a first or a subsequent AMDS group of a plurality of AMDS groups that are transmitted one after the other, which together include information of an SDC (service description channel) block.

26. A device for generating complementary data that are broadcast in an analog radio transmission system, the complementary data including information with respect to alternative transmitting frequencies of a respective program, comprising:

a processing circuit configured to:

convert SDC (service description channel) data into AMDS (amplitude modulation data system) data fields of AMDS groups;

ascertain check words, as a function of information included in the AMDS data fields, for detecting and correcting errors; and insert the ascertained check words into AMDS check fields;

wherein a data bit of each AMDS group indicates whether the respective AMDS group is a first or a subsequent AMDS group of a plurality of AMDS groups that are transmitted one after the other, which together include information of an SDC block.

27. A device for performing a method of an analog radio transmission system, comprising:

a computer processor configured to transmit complementary data in AMDS (amplitude modulation data system) groups, the complementary data including information with respect to alternative transmitting frequencies of a respective program;

wherein a data bit of each AMDS group indicates whether the respective AMDS group is a first or a subsequent AMDS group of a plurality of AMDS groups that are transmitted one after the other, which together include information of an SDC (service description channel) block.

* * * * *